US012426673B1

(12) United States Patent
Cheney et al.

(10) Patent No.: US 12,426,673 B1
(45) Date of Patent: Sep. 30, 2025

(54) ADJUSTABLE FOOTWEAR HAVING SOLE STRUCTURE WITH INTERDEPENDENT PARTS

(71) Applicant: FAST IP, LLC, Vineyard, UT (US)

(72) Inventors: Craig Cheney, Lindon, UT (US); Jensen Pratt, Alpine, UT (US); Alison Carlile, Vineyard, UT (US); Aislynn Edwards, Schenectady, NY (US); Joseph Eddington, American Fork, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/143,869

(22) Filed: Jan. 7, 2021

Related U.S. Application Data

(60) Provisional application No. 62/957,818, filed on Jan. 7, 2020.

(51) Int. Cl.

| | |
|---|---|
| ***A43B 13/16*** | (2006.01) |
| ***A43B 3/24*** | (2006.01) |
| ***A43B 3/26*** | (2006.01) |
| ***A43B 13/14*** | (2006.01) |

(52) U.S. Cl.
CPC ..... *A43B 13/16* (2013.01); *A43B 3/246* (2013.01); *A43B 3/26* (2013.01); *A43B 13/141* (2013.01)

(58) Field of Classification Search
CPC ..... A43B 3/26; A43B 11/00; A43B 3/246; A43B 13/184; A43B 3/0068; A43D 1/02; A43D 1/027; A63C 17/0086; A63C 2203/48; A43C 1/06; A43C 15/02; A43C 15/14; A43C 15/08; A43C 15/063
USPC ..... 36/97
See application file for complete search history.

(56) References Cited

U.S. PATENT DOCUMENTS

| | | | | |
|---|---|---|---|---|
| 1,539,762 A * | 5/1925 | Mussabini | ..... | A43B 3/10 36/97 |
| 1,830,648 A | 11/1931 | Engel | | |
| 2,112,052 A | 3/1938 | Smith | | |
| 2,776,499 A | 1/1957 | Guintini | | |

(Continued)

FOREIGN PATENT DOCUMENTS

| | | | |
|---|---|---|---|
| CN | 203969442 U | | 12/2014 |
| CN | 105455300 A | * | 4/2016 |

(Continued)

OTHER PUBLICATIONS

Translation of KR20170142828A (Year: 2017).*
Translation of KR 96-0002306 Y1 (Year: 1996).*
Translation of KR 200483055 Y1 (Year: 2017).*

*Primary Examiner* — Khoa D Huynh
*Assistant Examiner* — Grady Alexander Nunnery

(57) ABSTRACT

Example embodiments of the present disclosure comprise adjustable footwear having sole structure with interdependent parts. The sole structure may comprise multiple parts and/or portions that are configured such that relative movement between the multiple parts/portions and/or relative material properties of the multiple parts/portions facilitate and accommodate size adjustability of the sole structure (e.g., adjustability in length and/or width). In various embodiments, the interdependent portions of the sole structure may allow for adjustment in one or multiple directions in response to an action (e.g., a single action) taken by a user.

2 Claims, 6 Drawing Sheets

(56) References Cited

U.S. PATENT DOCUMENTS

| | | | | |
|---|---|---|---|---|
| 3,541,708 | A * | 11/1970 | Rosen | A43B 3/14 36/97 |
| 4,083,128 | A | 4/1978 | Rossman | |
| 4,813,157 | A | 3/1989 | Boisvert et al. | |
| 4,968,492 | A | 11/1990 | Rosen | |
| 5,036,604 | A | 8/1991 | Rosen | |
| 5,203,096 | A | 4/1993 | Rosen | |
| 5,241,762 | A | 9/1993 | Rosen | |
| 5,729,912 | A * | 3/1998 | Gutkowski | A43B 3/26 36/97 |
| 5,768,803 | A | 6/1998 | Levy | |
| 5,813,146 | A | 9/1998 | Gutkowski et al. | |
| 6,000,147 | A | 12/1999 | Kellerman | |
| 6,442,874 | B1 | 9/2002 | Long | |
| 6,450,510 | B1 | 9/2002 | Liu | |
| 6,920,707 | B1 | 7/2005 | Greene et al. | |
| 7,055,268 | B2 | 6/2006 | Ha | |
| 7,225,563 | B2 | 6/2007 | Chen et al. | |
| 7,392,604 | B2 | 7/2008 | Greene et al. | |
| 7,610,696 | B2 | 11/2009 | Davis | |
| 7,634,861 | B2 | 12/2009 | Kilgore | |
| 7,917,981 | B1 | 4/2011 | Lakic | |
| 8,590,177 | B1 * | 11/2013 | Quaeck | A43B 5/002 36/62 |
| 9,301,571 | B2 | 4/2016 | Langvin | |
| 9,491,983 | B2 | 11/2016 | Rushbrook | |
| 9,808,045 | B2 | 11/2017 | Carlson et al. | |
| 10,159,302 | B2 | 12/2018 | Carlson et al. | |
| 10,499,707 | B2 | 12/2019 | Hobson et al. | |
| 10,588,382 | B2 | 3/2020 | Rushbrook | |
| 10,602,797 | B2 | 3/2020 | Lintaman | |
| 10,645,990 | B2 | 5/2020 | Rushbrook | |
| 10,667,579 | B2 | 6/2020 | Elder et al. | |
| 10,736,379 | B2 | 8/2020 | Cook et al. | |
| 10,765,170 | B2 | 9/2020 | Langvin et al. | |
| 10,765,175 | B2 | 9/2020 | Panian et al. | |
| 10,779,607 | B1 | 9/2020 | Chandel | |
| 10,827,800 | B2 | 11/2020 | Iannuzzi | |
| 10,827,803 | B2 | 11/2020 | Bell et al. | |
| 11,033,072 | B2 | 6/2021 | Oda | |
| 11,044,962 | B2 | 6/2021 | Cheung | |
| 2002/0178614 | A1 | 12/2002 | Issler | |
| 2005/0060913 | A1 | 3/2005 | Chil et al. | |
| 2006/0107552 | A1 | 5/2006 | Clark et al. | |
| 2006/0162191 | A1 | 7/2006 | Mason | |
| 2007/0209236 | A1 * | 9/2007 | Ishak | A43C 15/14 36/61 |
| 2008/0127518 | A1 | 6/2008 | Byrne et al. | |
| 2008/0178493 | A1 | 7/2008 | Scofield | |
| 2009/0172972 | A1 | 7/2009 | Rosen | |
| 2011/0185600 | A1 | 8/2011 | Malek | |
| 2013/0152426 | A1 | 6/2013 | Lederer | |
| 2013/0219744 | A1 | 8/2013 | Case et al. | |
| 2014/0041256 | A1 | 2/2014 | Espinola | |
| 2014/0123516 | A1 | 5/2014 | Cressman et al. | |
| 2014/0182167 | A1 | 7/2014 | James et al. | |
| 2014/0215770 | A1 | 8/2014 | Levesque et al. | |
| 2014/0237850 | A1 | 8/2014 | Hull | |
| 2014/0259752 | A1 | 9/2014 | Feldman | |
| 2015/0366288 | A1 | 12/2015 | Miller | |
| 2017/0055626 | A1 * | 3/2017 | Rushbrook | A43C 1/003 |
| 2017/0056754 | A1 | 3/2017 | Yu et al. | |
| 2017/0188655 | A1 * | 7/2017 | Carlson | A43B 13/14 |
| 2018/0135213 | A1 | 5/2018 | Bell et al. | |
| 2018/0242694 | A1 | 8/2018 | Webster | |
| 2018/0255872 | A1 | 9/2018 | Manasiya | |
| 2018/0325216 | A1 | 11/2018 | Toronjo | |
| 2019/0297988 | A1 | 10/2019 | Oden et al. | |
| 2019/0380430 | A1 | 12/2019 | Seid | |
| 2020/0008516 | A1 | 1/2020 | Chan et al. | |
| 2020/0046080 | A1 | 2/2020 | Burns et al. | |
| 2020/0253334 | A1 | 8/2020 | Elder et al. | |
| 2020/0352282 | A1 | 11/2020 | Drake | |
| 2020/0367604 | A1 | 11/2020 | Angvin et al. | |
| 2020/0375301 | A1 | 12/2020 | Cheung | |
| 2021/0037912 | A1 | 2/2021 | Spencer | |
| 2021/0204639 | A1 | 7/2021 | Yang | |
| 2021/0219651 | A1 | 7/2021 | Rushbrook et al. | |
| 2021/0227925 | A1 | 7/2021 | Kim | |

FOREIGN PATENT DOCUMENTS

| | | | | |
|---|---|---|---|---|
| CN | 108851327 | A | 11/2018 | |
| CN | 109549280 | A | 4/2019 | |
| GB | 2432295 | A | 5/2007 | |
| KR | 96-0002306 | Y1 * | 3/1996 | A43B 3/00 |
| KR | 100540394 | A | 12/2005 | |
| KR | 200483055 | Y1 * | 3/2017 | A43B 1/00 |
| KR | 20170142828 | A * | 12/2017 | A43C 15/06 |
| WO | 2006106612 | A2 | 10/2006 | |

* cited by examiner

ADJUSTABLE FOOTWEAR HAVING SOLE STRUCTURE WITH INTERDEPENDENT PARTS

CROSS-REFERENCE TO RELATED APPLICATIONS

The present application claims priority to and the benefit of U.S. Provisional Application No. 62/957,818 filed Jan. 7, 2020, which is incorporated herein by reference in its entirety.

FIELD

The present disclosure relates to adjustable footwear having sole structure with interdependent parts.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

Disclosed herein, in various embodiments, is adjustable footwear having sole structure with interdependent parts. In various embodiments, the sole structure comprises a forward portion and a rearward portion. In various embodiments, at least one of relative movement between the forward portion and the rearward portion and relative material properties of the forward portion the rearward portion facilitate and accommodate size adjustability of the sole structure.

Also disclosed herein, according to various embodiments, is a sole structure for adjustable footwear, with the sole structure comprising a rotatable member and a plurality of ribs extending outward from the rotatable member. In various embodiments, rotation of the rotatable member provides length and width adjustments to the sole structure via the ribs.

Also disclosed herein, according to various embodiments, is a sole structure comprising a hinge structure and a pull cord coupled to the hinge structure. In response to a pulling force exerted by a user on the pull cord, the hinge structure is configured to provide at least one of length and width adjustments to the sole structure.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1:
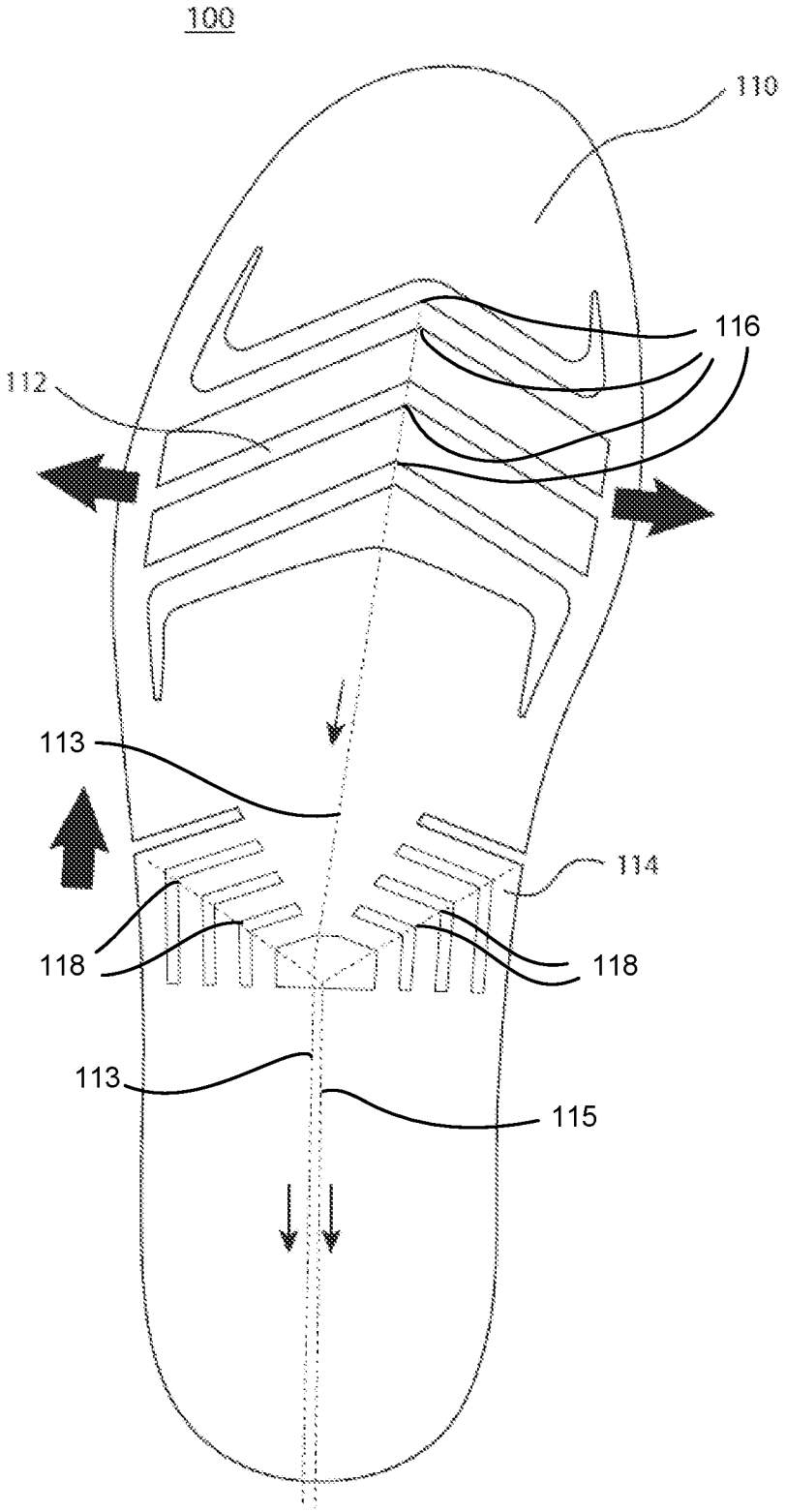
FIG. 1 illustrates a sole structure for adjustable footwear having a plurality of hinge structures, according to various embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112 (f) or pre-AIA 35 U.S.C. 112, sixth paragraph or the like unless it explicitly uses the term "means" and includes functional language.

In describing example embodiments of the adjustable footwear having sole structure with interdependent parts, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the adjustable footwear having sole structure with interdependent parts. These terms should be given meaning according to the manner in which the adjustable footwear having sole structure with interdependent parts is most typically designed for use, with the adjustable footwear having sole structure with interdependent parts on a user's foot and with the user's shod foot disposed on or ready for placement on an underlying surface. Thus, these directions may be understood relative to the adjustable footwear having sole structure with interdependent parts in such use. Similarly, as the adjustable footwear having sole structure with interdependent parts is intended primarily for use as footwear, terms such as "inner," "inward," "outer," "outward," "innermost," "outermost," "inside," "outside," and the like should be understood in reference to the adjustable footwear having sole structure with interdependent parts' intended use, such that inner, inward, innermost, inside, and the like signify relatively closer to the user's foot, and outer, outward, outermost, outside, and the like signify relatively farther from the user's foot when the adjustable footwear having sole structure with interdependent parts is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure provides for an adjustable shoe comprising a sole structure and an upper, the sole structure having one or more interdependent parts to provide for length and/or width adjustability of the shoe.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe. A sole structure herein may comprise one or more of nylon, acetal homopolymer/polyoxymethylene, aluminum, graphite, thermoplastic polyurethane (TPU), thermoplastic copolyester elastomer (TPC-ET), polypropylene, acrylic resin, rubber, titanium, acrylonitrile butadiene styrene (ABS), and polycarbonate. Such a material may comprise a shape-memory material.

Generally disclosed herein, according to various embodiments, is a sole structure of a shoe that comprises multiple parts and/or portions that are configured such that relative movement between the multiple parts/portions and/or relative material properties of the multiple parts/portions facilitate and accommodate size adjustability of the sole structure (e.g., adjustability in length and/or width). In various embodiments, as described in greater detail below, the interdependent portions of the sole structure may allow for adjustment in one or multiple directions in response to an action (e.g., a single action) taken by a user. In various embodiments, the sole structure may generally include two interdependent parts/portions (e.g., a forward portion and a rearward portion). These two interdependent parts may be separate components that are interconnected using various structures and features, as described below, or these two interdependent parts may be sections/regions of a common/unitary structure having ribs or other features extending between the two portions that allow for relative movement.

With reference to FIG. 1, and according to various embodiments, the sole structure 110 of a shoe 100 comprises one or more hinge structures 112, 114 that are configured to cause adjust a size (e.g., width or length) of the sole structure 110 in response to an action by a user. For example, the sole structure 110 may include one or more hinge structures 112 (e.g., a living hinge and/or an auxetic hinge structure) in the forward portion of the sole structure 110 configured to translate force/motion in a first direction (e.g., a rearward direction, by a pull cord 113 extending out of the rear of the shoe 100) to force/motion in a second direction (e.g., width expansion). Additionally, or alternatively, the sole structure 110 may include one or more hinge structures 114 (e.g., a living hinge and/or an auxetic hinge structure) in the rearward portion of the sole structure 110 configured to translate force/motion in a first direction (e.g., a rearward direction, by a pull cord 115 extending out of the rear of the shoe 100) to force/motion in a second direction (e.g., length expansion). Pull cord 113 may not necessarily be parallel to pull cord 115. Further, the pull cord(s) may not extend out through the rear of the shoe 100, but may extend out one of the sides of the shoe 100 or the front of the shoe 100.

The hinge structures 112, 114 may comprise one or more V-shaped ribs having vertices 116, 118 aligned along a direction of pull. The V-shaped ribs may constitute a series/set of living hinges. In accordance with various embodiments, when the angles defined by the one or more V-shaped ribs are increased, the ends of the one or more V-shaped ribs are spread apart to cause the desired translation. Correspondingly, when the angles defined by the one or more V-shaped ribs are decreased, the ends of the one or more V-shaped ribs are drawn together to reverse the desired translation. For example, the forward hinge structures 112 may have V-shaped ribs with vertices 116 pointing generally forward. Pull cord 113 may be affixed to the vertices 116 and in response to the rearward pull from the pull cord 113 the vertices may move rearward, thereby causing the ends of the ribs to be forced outwards and thus resulting in a width expansion.

According to another example, the rear hinge structures 114 may comprise two sets of V-shaped ribs. The sets of V-shaped ribs may have with vertices 118 that generally point forward and outward. That is, one set of the V-shaped ribs may have vertices that point forward and toward the lateral side of the sole structure and the other set of V-shaped ribs may have vertices that point forward and toward the medial side of the sole structure. In such a configuration, pull cord 115 may be a split cord (or may include two cords), with one cord section extending along and being affixed to the lateral vertices and another cord section extending along and being affixed to the medial vertices. In various embodiments, a rearward pulling force exerted by the user on pull cord(s) 115 may cause the vertices 118 to move inward and rearward, thereby causing the ends of the ribs to produce a size adjustment to the sole structure 110. For example, the forward ends of the ribs may move forward, thus resulting in a length expansion, and the rearward ends of the ribs may move outward, thus resulting in a width expansion. That is, a single action taken by the user (e.g., pulling pull cord 115 in a rearward direction) may result in a lengthened arch support and a widened forefoot.

In various embodiments, the sole structure 110 may define one or more channels or grooves through which the pull cords 113, 115 are routed. The channels may include rounded edges or may otherwise be shaped and configured to facilitate translation of the pull cords therethrough. In various embodiments, the sole structure 110 may include one or more bearings and/or pulleys to facilitate translation of the pull cord relative to the sole structure. In various embodiments, the pull cord(s) and/or the portions of sole structure through which the pull cord(s) are routed may be made from, or may at least be coated with, low-friction materials configured to facilitate relative movement.

In various embodiments, as described in greater detail below, instead of using pull cords to effectuate the translation, the various interdependent portions of the sole structure 110 may be directly grasped and/or manipulated by a user to cause the size adjustments. For example, the sole structure 110 may include one or more push or pull tabs that are configured to be grasped and manipulated by the user to cause the adjustment motion. In various embodiments, the hinge structure(s) 112, 114 are biased/predisposed to be in a certain configuration, and thus when the pull cords and/or push/pull tabs are not retained or secured, the sole structure may return to their default positions. Accordingly, the sole structure may include one or more retention mechanisms or anchoring features configured to reversibly secure the sole structure 110 in the adjusted position.

In various embodiments, the sole structure 110 may include one or more apertures positioned adjacent or defined around the hinge structure(s) 112, 114. For example, if the hinge structure includes ribs, apertures may be defined between adjacent ribs, thus allowing the ribs to deform as described above (e.g., to allow the material of the sole structure to bunch or collapse into the apertures). The apertures may be grooves defined in the bottom surface of the sole structure. The apertures may be recesses that only pass partially through the sole structure (i.e., do not extend completely through the sole structure) or the apertures may be pass-through apertures that completely extend through the sole structure.

Figure 2:
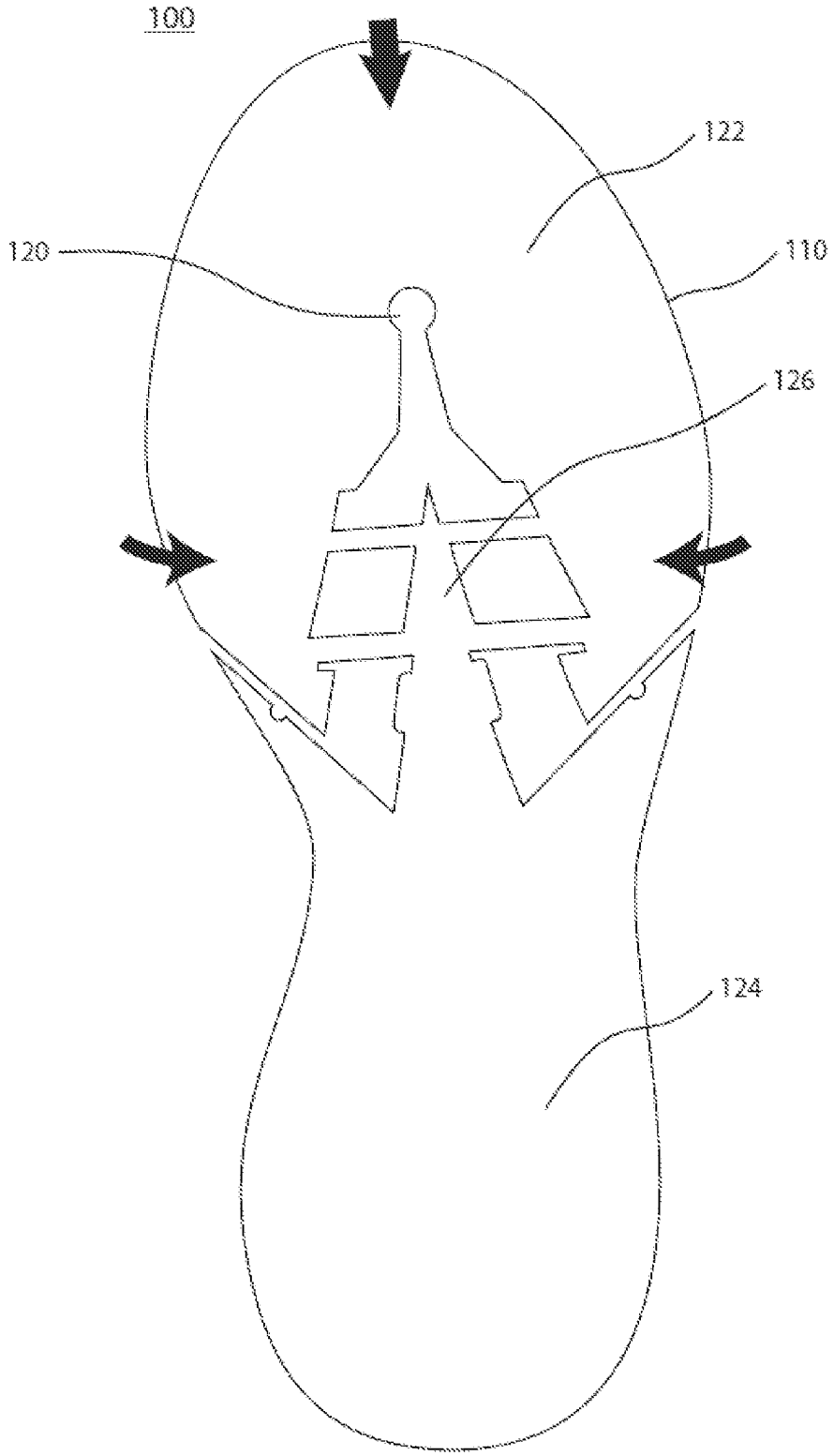
FIG. 2 illustrates a sole structure for adjustable footwear having interdependent parts having different material properties, according to various embodiments.

With reference to FIG. 2, the sole structure 110 of a shoe 100 comprises a forward portion 122 and a rearward portion 124 interdependent on one another, wherein one or more lateral and curved edges of the forward portion 122 are positioned adjacent to and within one or more lateral and angled edges of the rearward portion 124 such that drawing them closer (or apart from one another) along a first axis draws them closer (or apart from one another) along a second axis substantially parallel to the first axis. That is, the edges of the rearward portion can compress the edges of the forward portion when the two portions are drawn closer to one another, resulting in corresponding length and width adjustment. The edges of the portions can comprise a tongue and groove interference, or the like, to facilitate relative motion. As discussed below, the interdependent parts can be connected by one or a plurality of ribs 126 (e.g., such that the forward and rearward portions are a unitary structure). In example embodiments, the forward portion 122 comprises one or more apertures 120 to accommodate width adjustability in response to the described motion.

In various embodiments, the portions 122, 124 of the sole structure 110 may have different material properties that allow for one of the portions to preferentially deform. For example, the rearward portion 124 may be more rigid and/or less flexible than the forward portion 122, and thus the rearward portion 124 may function as a rigid base against which the forward portion 122 is deformed in order to produce the desired adjustment. Said differently, the size adjustments may be accomplished due to relative material properties of the sole portions 122, 124. Accordingly, while in various embodiments the interface between the two portions 122, 124 may be configured for relative movement, in various embodiments the interface between the two portions 122, 124 does not have any relative movement, but instead a force exerted on one of the portions results in a deformation of the other.

Figure 3A:
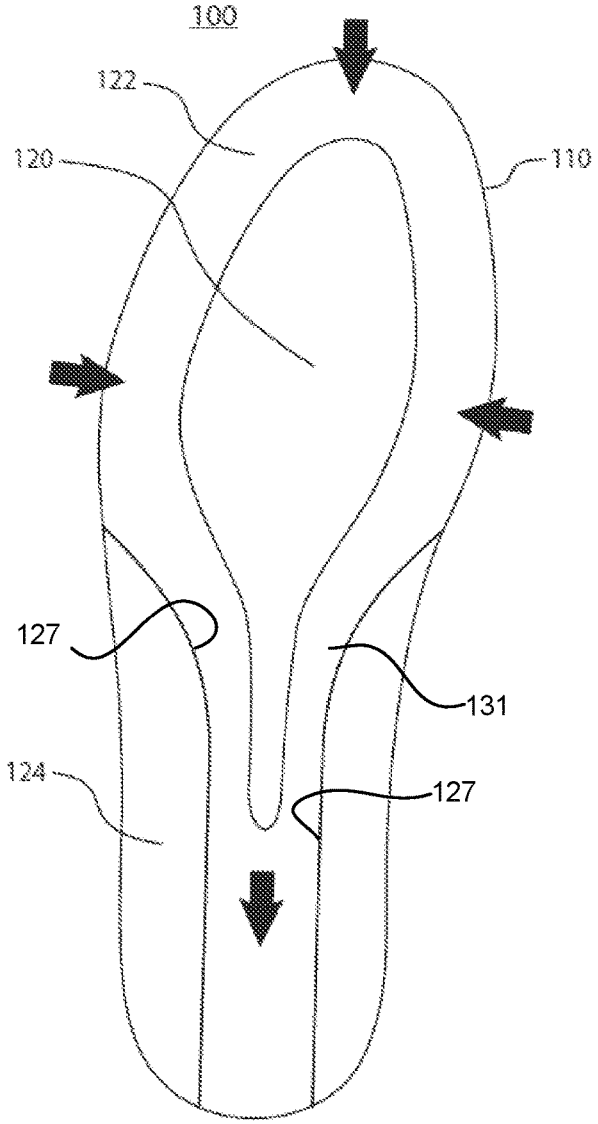
FIGS. 3A and 3B illustrate a sole structure for adjustable footwear having a forward portion configured to move relative to a rearward portion, in accordance with various embodiments.
Figure 3B:
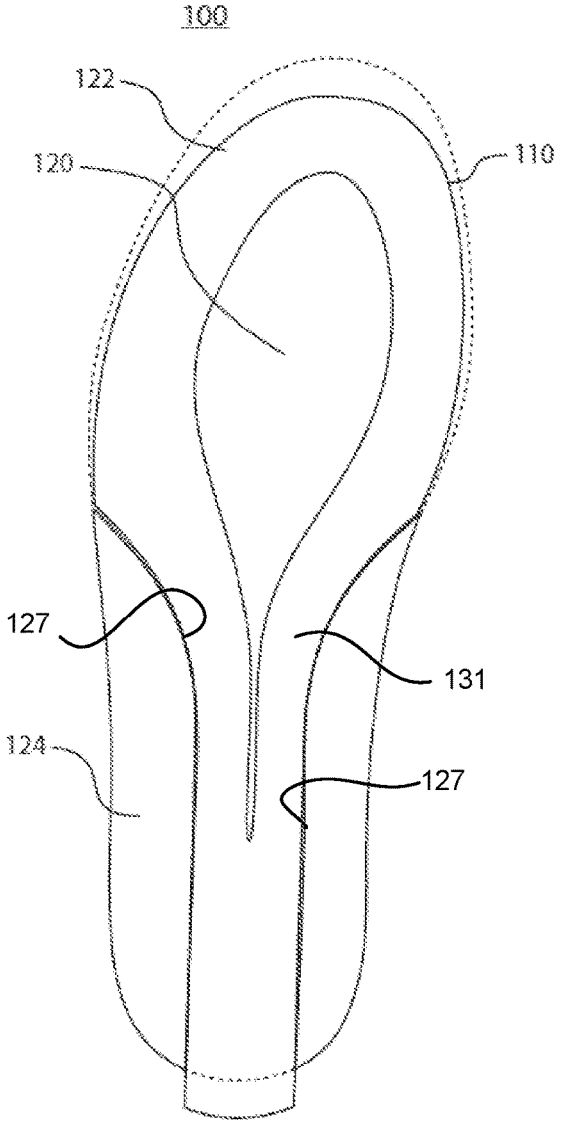

With reference to FIGS. 3A and 3B, the sole structure 110 of a shoe 100 comprises a forward portion 122 and a rearward portion 124 interdependent on one another, wherein one or more lateral and curved edges of the forward portion 122 are positioned adjacent to and within one or more lateral and angled edges of the rearward portion 124. Similar to above, drawing them closer (or apart from one another) along a first axis draws them closer (or apart from one another) along a second axis substantially parallel to the first axis. That is, the edges of the rearward portion can compress the edges of the forward portion when the two portions are drawn closer to one another, resulting in corresponding length and width adjustment. The edges of the portions can comprise a tongue and groove interference, or the like, to facilitate relative motion. In this embodiment, the forward portion 122 extends all or partially through the rearward portion 124 (which may, in turn, comprise two separate portions), and the forward portion 122 comprises one or more apertures 120 to accommodate width adjustability in response to the described motion.

In various embodiments, the rearward portion 124 defines a rear channel 127 through which a tapered section 131 of the forward portion 122 extends. The rear channel 127 may define a recess that converges from the forward of the sole structure to the rear of the sole structure. The rear channel 127 may have a substantially linear section. The forward portion 122 may define a central aperture 120, and in response to a rearward pulling force exerted by a user on the tapered section 131 of the forward portion 122, the tapered section 131 may be compressed further into the converging sidewalls of the rear channel 127, thus resulting in a lengthwise contraction of the sole structure. The resultant compression of the tapered section 131 may also result in a width-wise contraction of a least the forward portion of the sole structure. The aperture 120 of the forward portion 122 may allow for the sole structure to be compressed inward. Such an assembly may be self-contained.

Figure 4A:
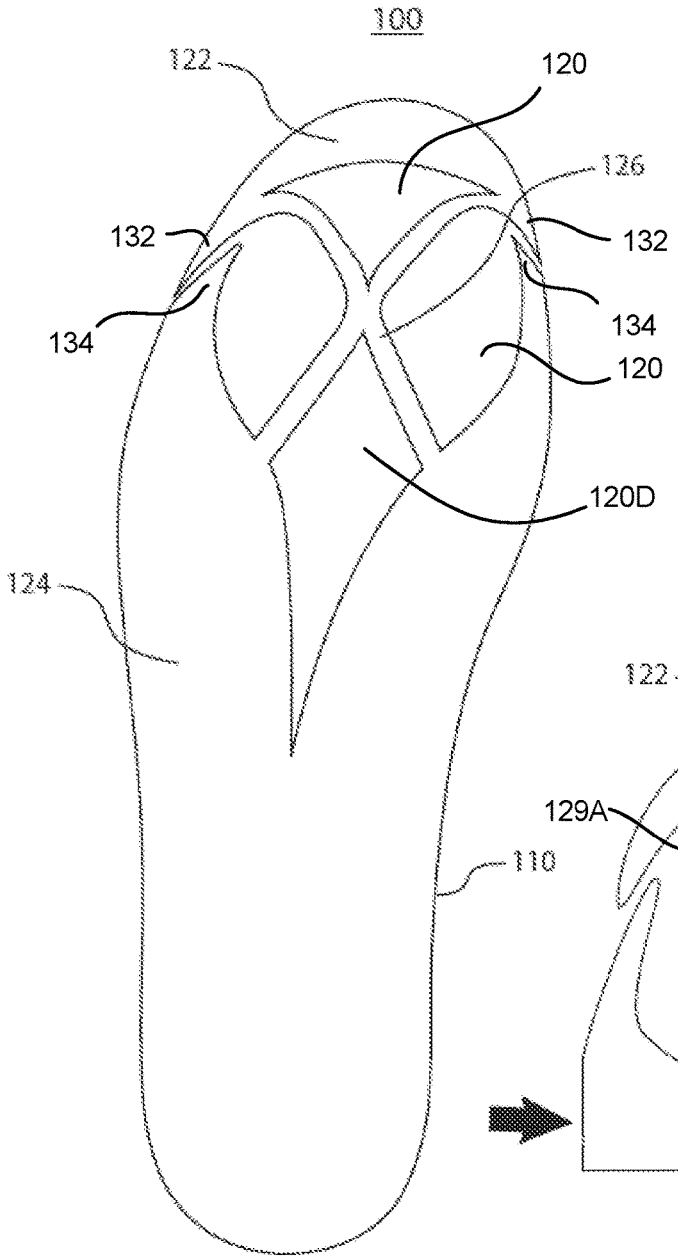
FIGS. 4A and 4B illustrate various interconnecting structures extending between a forward portion and a rearward portion of a sole structure, in accordance with various embodiments.
Figure 4B:
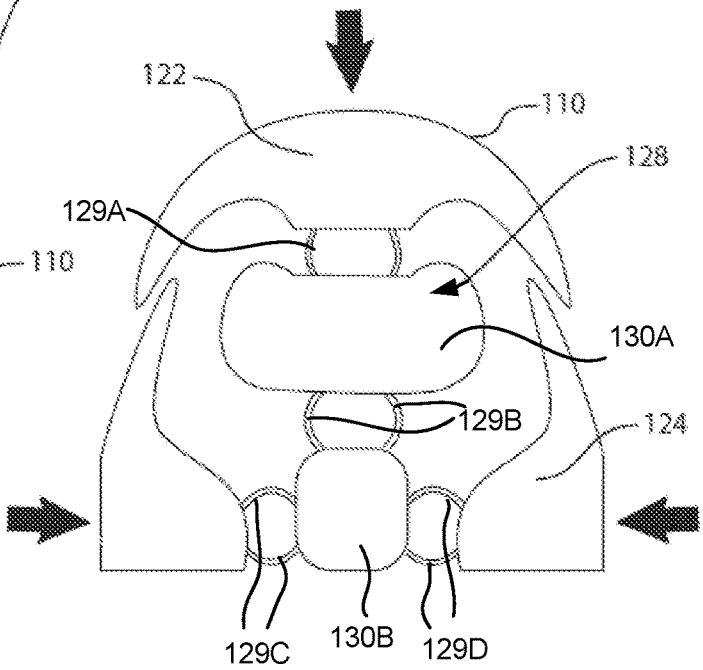

With reference to FIGS. 4A and 4B, the sole structure 110 of a shoe 100 comprises a forward portion 122 and a rearward portion 124 interdependent on one another, wherein one or more lateral and curved edges of the rearward portion 124 are positioned adjacent to and within one or more lateral and angled edges of the forward portion 122 such that drawing them closer (or apart from one another) along a first axis draws them closer (or apart from one another) along a second axis substantially parallel to the first axis. That is, the edges of the forward portion can compress the edges of the rearward portion when the two portions are drawn closer to one another, resulting in corresponding length and width adjustment. The edges of the portions can comprise a tongue and groove interference, or the like, to facilitate relative motion. Again, the interdependent parts can be connected by one or a plurality of ribs 126 or a leaf spring assembly 128.

In various embodiments, and with reference to FIG. 4A, the sole structure includes a plurality of ribs 126 extending between the forward portion 122 and the rearward portion 124 of the sole structure 110. The plurality of ribs 126 may have an X-shape, with apertures 120 defined between and around the legs of the X-shape. The plurality of ribs 126 may be generally positioned in the forward half of the shoe 100. The rearward-most aperture 120D may be defined between the plurality of ribs 126 and the rearward portion 124, and may have a diamond-shape. The rearward vertex of the diamond shape may extend to the lengthwise midpoint of the sole structure, or even further. The forward portion 122 of the sole structure may comprise a toe-lip section having a tip 132 on each of the medial and lateral side that extend rearward and outward. The tips 132 may continue an arcing curvature of two of the legs of the X-shape of the plurality of ribs 126. In various embodiments, the rearward portion 124 may also include tips 132 that face forward and inward, and that are generally configured to conform/complement tips 132.

In various embodiments, and with reference to FIG. 4B, instead of an X-shape formation of ribs extending between the forward portion 122 and the rearward portion 124 of the sole structure 110, a leaf spring assembly 128 may extend between and interconnect the interdependent parts 122, 124. The leaf spring assembly 128 may include a plurality of leaf springs 129 and structural connectors 130. Each of the leaf springs 129 may include an opposing pair of resiliently flexible strips of material facing each other in an elliptical shape. In various embodiments, two leaf springs 129A, 129B may be interconnected by a structural connector 130A, with the forward-most leaf spring 129A coupled to the forward portion 122 of the sole structure and the other leaf spring 129B coupled to a rearward-most structural connector 130B. Leaf springs 129A and 129B may facilitate and accommodate lengthwise adjustments. Another two leaf springs 129C, 129D may be interconnected by the rearward-most structural connector 130B, with these two leaf springs 129C and 129D being coupled to opposing and forwardly extending sections of the rearward portion 124 of the sole structure 110. These two leaf springs 129C and 129D may facilitate and accommodate width-wise adjustments. While the foregoing example is described in connection with a leaf spring, other spring assemblies are contemplated herein, for example, a wave spring, coil spring, or any other spring known in the art or hereinafter developed. Alternatively, leaf springs 129 can be comprised of blocks of material configured to be resiliently deformable.

Figure 5A:
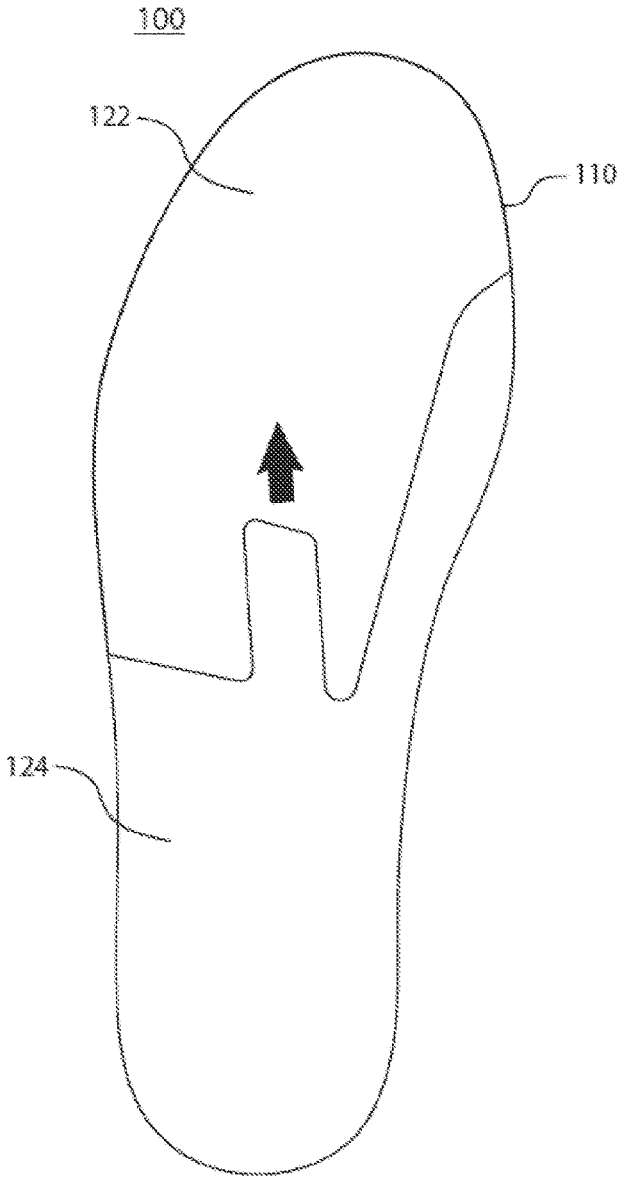
FIGS. 5A and 5B illustrate a sole structure for adjustable footwear having a forward portion configured to move relative to a rearward portion, in accordance with various embodiments.
Figure 5B:
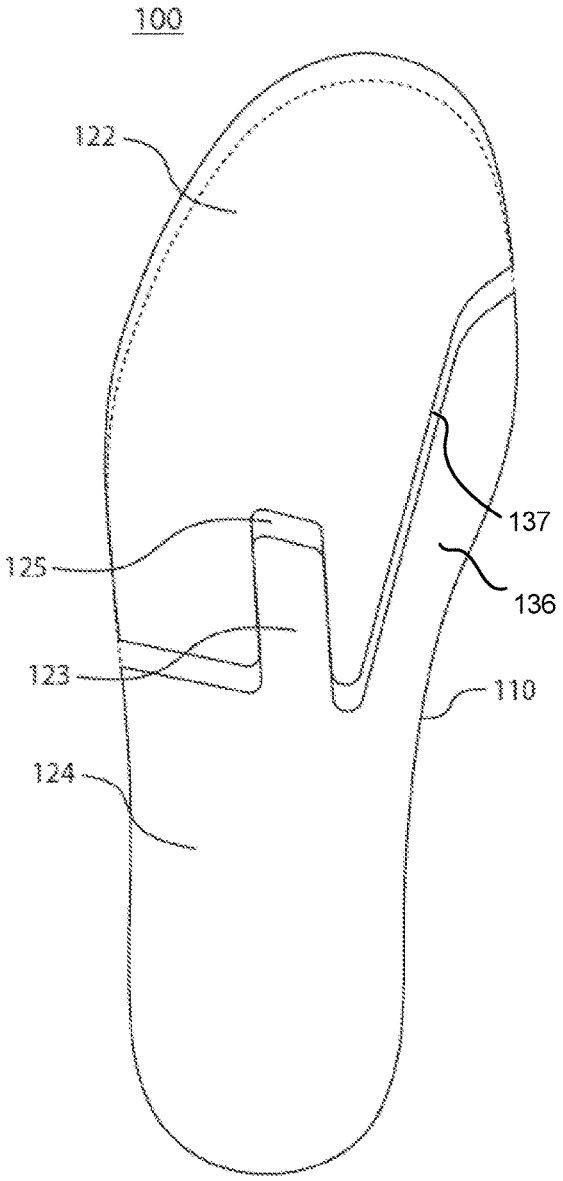

With reference to FIGS. 5A and 5B, the sole structure 110 of a shoe 100 comprises a forward portion 122 and a rearward portion 124 moveable relative to each other, for example, one portion having an tongue 123 and the other portion having a corresponding groove 125 for slideably receiving the extension. In example embodiments, the forward portion 122 and the rearward portion 124 are moveable relative to each other along a length, and optionally a width, of the shoe. In such embodiments, the tongue 123 and the corresponding groove 125 can have some curvature or be angled relative to an axis bisecting lateral and medial portions of the shoe 100.

In various embodiments, and with continued reference to FIGS. 5A and 5B, the tongue 123 of the rearward portion 124 is generally centrally disposed on the sole structure 110, with the corresponding and/or complementary groove 125 defined by the forward portion 122 of the sole structure 110. The rearward portion 124 of the sole structure 110 may also include an extension 136 on the medial side of the sole structure 110 that extends farther forward than the tongue 123. The extension 136 may extend to the region of the sole structure 110 that is configured to be disposed below the ball of the foot of the user. The forward portion 122 of the sole structure may include a corresponding and/or complementary recess 137 that receives the extension 136. In various embodiments, an interference fit between the tongue 123 and the groove 125 facilitates controlled lengthwise adjustment of the sole structure 110. The interface/gap between the extension 136 and the complementary recess 137 may be oriented to extend forward and toward the medial edge of the sole structure 110. This interface/gap may have a larger span at a medial end flare. Due to the angled extension direction of this interface/gap, lengthwise relative movement between the interdependent parts 122, 124 may produce a width adjustment, at least to the forward region of the sole structure 110.

Figure 6:
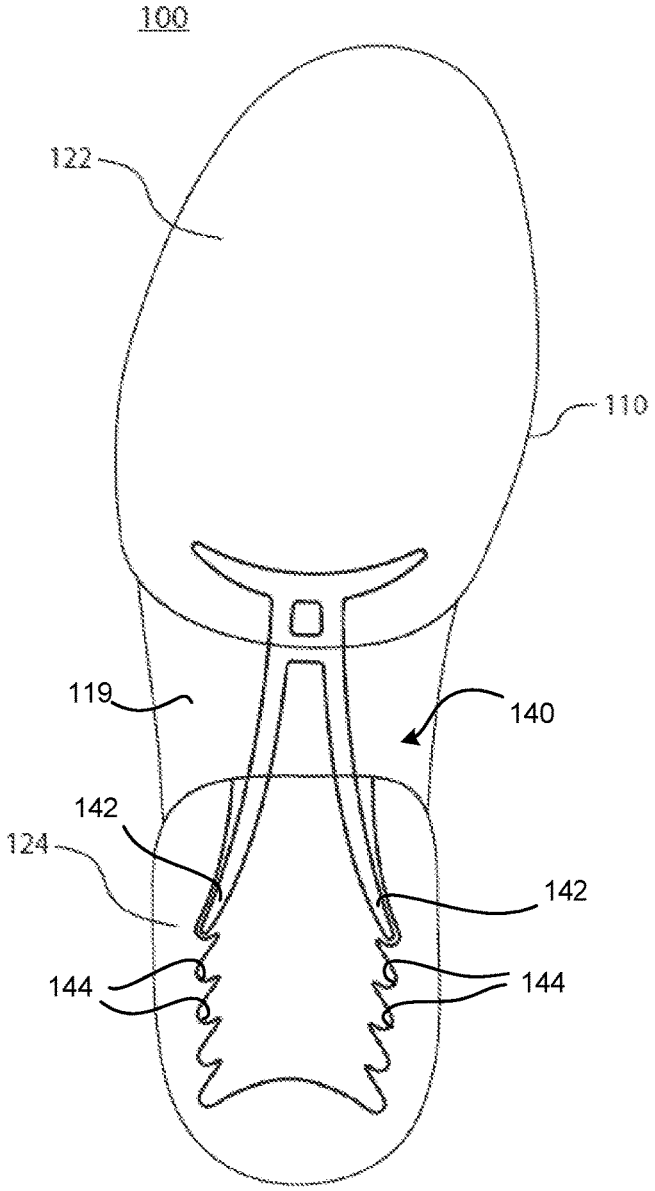
FIG. 6 illustrates a sole structure for adjustable footwear comprising a ratchet mechanism, in accordance with various embodiments.

With reference to FIG. 6, the sole structure 110 of a shoe 100 comprises a forward portion 122 and a rearward portion 124 moveable relative to each other, for example, with a ratchet mechanism 140. In this regard, in example embodiments, the ratchet mechanism 140 includes a pair of teeth 142 mounted to the forward portion 122 and a plurality of corresponding grooves 144 open inward and defined by the rearward portion 124 of the sole structure 110. Accordingly, the ratchet mechanism 140 may enable controlled and incremental lengthwise adjustments to the sole structure. In various embodiments, the teeth 142 extend from the forward portion 122 to the grooves 134 of the rearward portion 124, and the sole structure 110 may include an adjoining region 119 between the forward portion 122 and the rearward portion 124 that is configured to stretch and compress in response to the lengthwise adjustments accomplished by the ratchet mechanism 140.

Figure 7:
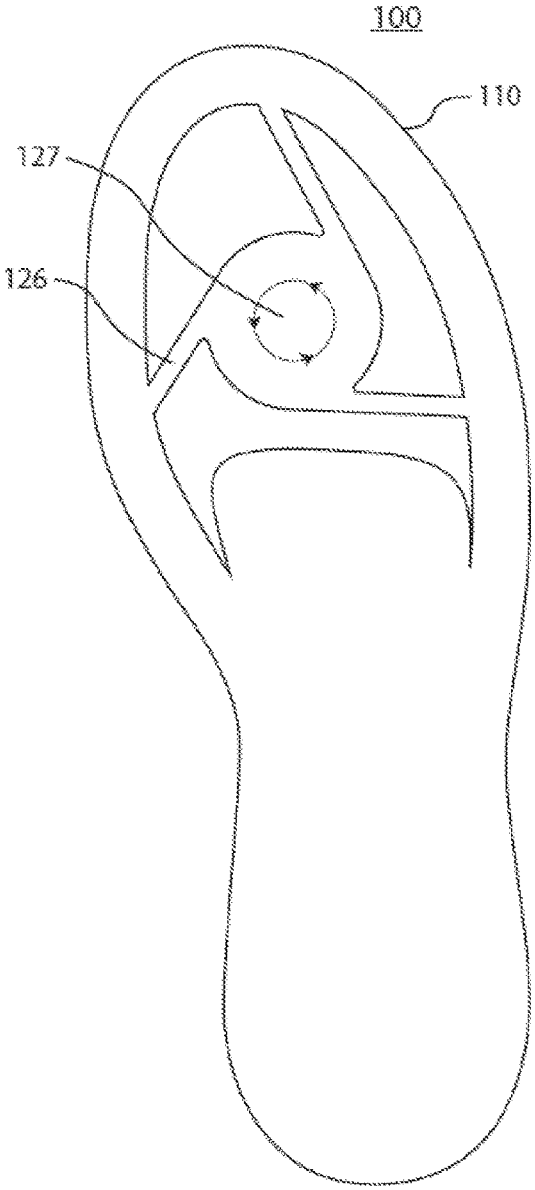
FIG. 7 illustrates a sole structure for adjustable footwear having a rotatable member and a plurality of ribs, in accordance with various embodiments.

With reference to FIG. 7, the sole structure 110 of a shoe 100 comprises one or a plurality of ribs 126 extending from a rotatable member 127, wherein rotation of the rotatable member 127 provides for corresponding length and width adjustment of the sole structure 110 via the ribs 126. In various embodiments, apertures may be disposed around the rotatable member 127 between circumferentially adjacent ribs of the plurality of ribs 126. In various embodiments, in response to rotation of the rotatable member 127, the ribs 126 which extend outward from the rotatable member 127 may push or pull on regions of the sole structure 110 to cause expansion and/or contraction of the sole structure. Said differently, the ribs 126 may not extend directly radially outward from the rotatable member 127, but instead each of the ribs 126 may extend at an angled orientation from the rotatable member 127 (e.g., offset from a radial direction). The offset from radial may be substantially uniform for each of the ribs 126. Accordingly, and using the depiction and perspective of FIG. 7 as an example, clockwise rotation of the rotatable member 127 would produce a compression of the sole structure 110, as the portions of the sole structure to which the ribs 126 are connected would be pulled inwards toward the rotatable member 127. Correspondingly, counter-clockwise rotation of the rotatable member 127 would produce and expansion of the sole structure 110, as the portions of the sole structure to which the ribs 126 are connected would be pushed outward/forward. The rotatable member 127 is, in some embodiments, accessibly located underneath a footbed of the shoe 100. In various embodiments, the user may access/actuate the rotatable member 127 using a key or other feature that is inserted through an aperture or hole defined in the sole structure. For example, the user may insert a tool through the bottom surface, the top surface (e.g., the footbed), or a side wall of the sole structure to engage and actuate the rotatable member 127. The rotatable member 127 may include a ratcheting assembly to reversibly lock the rotatable member in place. In various embodiments, the key/tool used for actuation of the rotatable member 127 may be a section of the shoe, for example a shoelace having an aglet key (e.g., a hex key, a star key, or a key having a distinctive shape) configured to engage with and rotate the rotatable member 127.

A shoe as described herein can have an open configuration, in which the shoe 100 has a larger length and/or width than in a closed configuration.

A shoe as described herein can have a closed configuration, in which the shoe 100 has a smaller length and/or width than in an open configuration.

In some embodiments, the spaces between interdependent parts are merely voids, while in other embodiments, the spaces between interdependent parts are comprised of a filler material or structure, for example, a material less dense that the martial defining the spaces between interdependent parts, an air pocket, a leaf spring, or one or a plurality of ribs (e.g., organized in a lattice structure and/or an auxetic pattern). The filler material or structure can bias, at least in part, the shoe from a closed to an open configuration, or, alternatively, from an open to a closed configuration.

In this regard, in some embodiments, the shoe is biased in an open configuration, while in other embodiments, the shoe is biased in a closed configuration. In still other embodiments, the shoe is bi-stable (i.e., in both an open configuration and a closed configuration).

In some embodiments, securement in and/or transition between, open and closed configurations, which may be incremental, is controlled by one or more of a belt, ratchet (e.g., a zip-tie mechanism), cord (e.g., extending through a sole structure out of the rear of the shoe), strap with hook and loop fasteners, or the like, in some embodiments with a quick release, surrounding all or a portion of the sole structure. For example, a strap can be belted through apertures in a perimeter of a sole structure. In other embodiments, securement in and/or transition between, open and closed configurations, is controlled by an air bladder. In still other embodiments, securement in and/or transition between, open and closed configurations, is controlled by a screw, cord or the like extending through one or more spaces between interdependent parts, which may further be driven by a cam system, e.g., including an eccentric wheel. In yet other embodiments, securement in and/or transition between, open and closed configurations, is controlled by an eccentric wedge element positioned in one or more apertures that, when turned, transitions the aperture(s) from a closed to an open configuration, or, alternatively, from an open to a closed configuration. Moreover, a shoe in accordance with the present disclosure may comprise one or more visual, tactile or audible indicators of adjustment (e.g., a click every 2 mm or a mark corresponding to 2 mm). In connection with example embodiments, the sole structure may have a surrounding bumper surrounding all of a portion of the sole structure, the bumper having one or more folds, pleats or baffles, or overlapping or telescoping portions, to accommodate length and/or width adjustability of the shoe.

To accommodate adjustment to length and/or width of the sole structure, an upper coupled to the sole structure may be comprised of an expandable material (e.g., a knit, stretch or elastic material), comprise one or more gussets or gores, and/or comprise overlapping or folding panels. Additionally, coupling of an upper to the sole structure may not be at the spaces between interdependent parts (regardless of whether comprising a filler material or structure as described herein). For example, an adhesive may be selectively applied (e.g., screen printed) to the sole structure only around the spaces between interdependent parts (i.e., not covering the spaces between interdependent parts). Additionally, a footbed of a shoe in accordance with the present disclosure may comprise one or more features to accommodate length and/or width adjustability of the shoe, for example, one or more expandable/collapsible apertures, gussets, gores, overlapping or folding panels, or the like. Additionally, the sole structure may be covered with a hardened material to provide protection from objects extending through the apertures and/or to provide comfort relative to the apertures.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A sole structure for adjustable footwear, the sole structure comprising:

a width hinge structure comprising a first V-shaped rib;

a length hinge structure comprising a second V-shaped rib;

a width pull cord coupled to the width hinge structure and aligned through a vertex of the first V-shaped rib; and a length pull cord coupled to the length hinge structure and aligned through a vertex of the second V-shaped rib;

wherein in response to a pulling force exerted by a user on the width pull cord, the width hinge structure is configured to provide adjustment to the width of the sole structure; and wherein in response to a pulling force exerted by a user on the length pull cord, the length hinge structure is configured to provide adjustment to the length of the sole structure.

2. The sole structure of claim 1, wherein a portion of the width pull cord is not parallel to a portion of the length pull cord.

* * * * *